US009132060B2

(12) United States Patent
Omura et al.

(10) Patent No.: US 9,132,060 B2
(45) Date of Patent: Sep. 15, 2015

(54) MEDICINE FEEDER

(75) Inventors: Yoshihito Omura, Tokyo (JP); Syunji Ohgaya, Tokyo (JP)

(73) Assignee: TOSHO INC., Tokyo (JP)

( * ) Notice: Subject to any disclaimer, the term of this patent is extended or adjusted under 35 U.S.C. 154(b) by 219 days.

(21) Appl. No.: 13/992,096

(22) PCT Filed: Dec. 9, 2011

(86) PCT No.: PCT/JP2011/078570

§ 371 (c)(1),
(2), (4) Date: Jun. 6, 2013

(87) PCT Pub. No.: WO2012/077788

PCT Pub. Date: Jun. 14, 2012

(65) Prior Publication Data

US 2013/0267927 A1 Oct. 10, 2013

(30) Foreign Application Priority Data

Dec. 9, 2010 (JP) ..... 2010-274197

(51) Int. Cl.
*B67D 1/00* (2006.01)
*A61J 1/14* (2006.01)
*A61J 3/10* (2006.01)

(52) U.S. Cl.
CPC . *A61J 1/1475* (2013.01); *A61J 3/10* (2013.01)

(58) Field of Classification Search
CPC ... B65D 83/04; B65D 83/0409; A61J 1/1475; A61J 2001/1481; A61J 3/10
USPC ..... 222/52, 63.167, 185.1, 333, 336.338, 222/341, 367, 368, 63, 167; 221/263–265
See application file for complete search history.

(56) References Cited

U.S. PATENT DOCUMENTS 4,024,984 A * 5/1977 Gyimothy et al. ..... 221/203
4,538,650 A 9/1985 Kodama et al.

(Continued)

FOREIGN PATENT DOCUMENTS

JP 50-143948 11/1975
JP 56-146130 11/1981

(Continued)

OTHER PUBLICATIONS

Information Statement cited by 3rd party and submitted to Japanese Patent Office on Apr. 5, 2013, 6 pages.

*Primary Examiner* — Lien Ngo
(74) *Attorney, Agent, or Firm* — Rankin, Hill & Clark LLP

(57) ABSTRACT

A medicine feeder that causes no axial rotation beyond control during fitting between transmission mechanisms includes a medicine storing device and a drive device. The medicine storing device includes a container and discharge mechanism. The container stores medicines. The discharge mechanism is rotationally driven to discharge medicines from the container, and includes a first transmission mechanism with a fitting portion. The drive device rotationally drives the discharge mechanism when the medicine storing device is brought into a cooperation enabling position, and includes a second transmission mechanism. When the fitting portion of the first transmission mechanism and the fitted portion of the second transmission mechanism are fitted with each other, the drive device can rotationally drive the discharge mechanism of the medicine storing device. The fitted portion is supported to be displaceable in the axial direction of a drive shaft, and moved by an energy storing member.

4 Claims, 16 Drawing Sheets

(56) References Cited

U.S. PATENT DOCUMENTS

| | | | | |
|---|---|---|---|---|
| 4,903,861 | A * | 2/1990 | Yuyama | 221/265 |
| 5,711,704 | A * | 1/1998 | Hughes et al. | 453/57 |
| 6,170,229 | B1 * | 1/2001 | Kim | 53/155 |

FOREIGN PATENT DOCUMENTS

| | | |
|---|---|---|
| JP | 57-7660 | 2/1982 |
| JP | 59-91389 | 6/1984 |
| JP | 06-066326 | 3/1994 |
| JP | 06-173966 | 6/1994 |
| JP | 11-114020 | 4/1999 |
| JP | 11-226088 | 8/1999 |
| JP | 2002-154637 | 5/2002 |
| JP | 2002-186658 | 7/2002 |
| JP | 2005-111104 | 4/2005 |
| JP | 2005-289506 | 10/2005 |
| JP | 2005-342122 | 12/2005 |
| JP | 2011-083357 | 4/2011 |

* cited by examiner

MEDICINE FEEDER

TECHNICAL FIELD

The present invention relates to a medicine feeder configured to discharge a medicine through cooperation between a medicine storing device and a drive device, the medicine storing device including a container configured to store a medicine and a discharge mechanism configured to discharge the medicine little by little, and the drive device being configured to drive the discharge mechanism. More particularly, the present invention relates to a medicine feeder in which the medicine storing device and the drive device are cooperatively coupled to each other to be able to transmit rotation through fitting between a fitting portion of a first transmission mechanism provided to the medicine storing device and a fitted portion of a second transmission mechanism provided to the drive device.

BACKGROUND ART

FIG. 18 includes side views of a medicine feeder 10 for powder medicines 6 (medicines) (see Patent Document 1, for example). FIG. 19 includes a perspective view etc. of a medicine feeder 10 for tablets 8 (medicines) (see Patent Documents 2 to 5, for example). Each of the medicine feeders 10 includes a medicine storing device 20 and a drive device 30 formed separately. When a first transmission mechanism of the medicine storing device 20 and a second transmission mechanism of the drive device 30 are brought into a fitted state with the medicine storing device 20 and the drive device 30 placed in a cooperation enabling position relative to each other, the medicine storing device 20 and the drive device 30 are coupled to each other for cooperation.

Specifically, each of the medicine storing devices 20 shown in FIGS. 18 and 19 includes a container 21 and a discharge mechanism 22. The container 21 stores therein medicines replenished when a lid is opened. The discharge mechanism 22 includes a rotary member 22A configured to be rotationally driven to discharge the medicines from a through hole in the bottom portion of the container 21. The discharge mechanism 22 is provided with a first transmission mechanism 23 operable to transmit a rotational drive force to the discharge mechanism 22. The first transmission mechanism 23 includes a fitting portion 23A. In most cases, the medicine storing device 20 uses cassettes, and is of a removable type or a movable-replaceable type.

In the removable medicine storing device 20 such as that of the medicine feeder shown in FIG. 19, the cooperation enabling position is achieved when the medicine storing device 20 is mounted to the drive device 30. In the movable-replaceable medicine storing device 20 such as that shown in FIG. 18, the cooperation enabling position is achieved when the medicine storing device 20 is closest to or faces the drive device 30. The discharge mechanism 22 may be provided in the middle of a discharge passage 24, or the discharge mechanism 22 may be partially provided in the container 21.

In order to rotationally drive the discharge mechanism 22 when the medicine storing device 20 is in the cooperation enabling position, the drive device 30 includes a motor and a second transmission mechanism 33. The motor is disposed in a casing for a control section 32. The second transmission mechanism 33 transmits a rotational drive force of the motor to the outside. The second transmission mechanism 33 includes a fitted portion to be fitted with the fitting portion of the first transmission mechanism 23. In most cases, the drive device 30 is attached to a shelf or a housing base member 31 to be stationary. A discharge sensor 34 is provided in the middle of the discharge passage or at the discharge destination to detect whether or not the medicines are discharged, measure the discharged medicines, and so forth.

When the removable medicine storing device 20 is mounted to the drive device 30 so that the two devices are brought into the cooperation enabling position, or when the movable-replaceable medicine storing device 20 is moved to cause advancing and retracting operation of the second transmission mechanism 33 of the drive device 30, the fitting portion 23A of the first transmission mechanism 23 provided to the medicine storing device 20 and the fitted portion 33A of the second transmission mechanism 33 provided to the drive device 30 are fitted with each other to enable the drive device 30 to rotationally drive the discharge mechanism 22.

In order to allow smooth insertion and extraction of the fitting portion 23A and the fitted portion 33A of the first and second transmission mechanisms 23 and 33 in each of the removable and movable-replaceable medicine feeders 10, the fitting portion 23A and the fitted portion 33A must be loosely fitted with each other with play. Therefore, the fitting portion 23A and the fitted portion 33A are not coupled to each other to be able to transmit rotation when the fitting portion 23A and the fitted portion 33A are simply fitted with each other. Thus, the fitting portion 23A and the fitted portion 33A are shaped to form a meshing structure that causes no slipping in the rotational direction between the fitting portion 23A and the fitted portion 33A. Specifically, the fitting portion 23A of the first transmission mechanism 23 includes an internally toothed gear, and the fitted portion 33A of the second transmission mechanism 33 includes an externally toothed gear to be meshed with the internally toothed gear. Consequently, when the fitting portion 23A and the fitted portion 33A are moved relative to each other in the rotational axis direction with their axes matching each other to reduce the relative distance therebetween, the fitting portion 23A and the fitted portion 33A are meshed with each other at the same time as they are fitted with each other (see FIG. 20A).

RELATED ART DOCUMENT

Patent Document

Patent Document 1: JP 11-114020 A
Patent Document 2: JP 11-226088 A
Patent Document 3: JP 2002-154637 A
Patent Document 4: JP 2005-342122 A
Patent Document 5: JP 2009-236992 A

SUMMARY OF INVENTION

Technical Problem

In the medicine feeders according to the related art, as discussed above, the fitting portion 23A of the first transmission mechanism 23 and the fitted portion 33A of the second transmission mechanism 33 each include a gear. This allows the fitting portion 23A of the first transmission mechanism 23 and the fitted portion 33A of the second transmission mechanism 33 to be fitted and meshed with each other when the medicine storing device 20 and the drive device 30 are disposed in the cooperation enabling position with respect to each other. Then, the drive device 30 drives the rotary member 22A of the discharge mechanism 22 to rotate the rotary member 22A. In replacing the medicine storing device 20, however, the teeth provided to the rotary member 23A of the first transmission mechanism 23 are occasionally deviated from the teeth provided to the fitted portion 33A of the second transmission mechanism 33 (see FIG. 20B). The deviation angle θ may reach up to half the pitch angle ϕ of the teeth.

Even if such deviation occurs, the deviation angle θ is resolved by forcibly rotating one or both of the transmission mechanisms when the fitting portion 23A of the first transmission mechanism 23 and the fitted portion 33A of the second transmission mechanism 33 are fitted with each other (see FIG. 20A). Because the motor is provided in the control section 32 for the drive device 30 and a speed reducing gear or the like configured to augment a rotational load is often incorporated, the fitting portion of the first transmission mechanism 23 is rotated by an external force in most cases. However, rotating the first transmission mechanism 23 while the drive device 30 is not in operation may incur undesirable discharge operation beyond control. Therefore, the effect of unwanted rotation of the first transmission mechanism 23 has hitherto been suppressed or mitigated for practicality.

In specific examples, measures have been taken by such as reducing the pitch angle ϕ of the teeth of the gears to suppress the maximum value of the deviation angle θ, and rotationally driving the discharge mechanism 22 in reverse by an appropriate angle before the fitting is released or after the medicines are completely discharged.

However, there has been an increasing demand to improve the reliability and the accuracy of the medicine feeders, and merely repeatedly taking the traditional measures may no longer meet such demands.

An object of the present invention is to provide a medicine feeder that causes no axial rotation beyond control during fitting.

Solution to Problem

The present invention provides a medicine feeder including a medicine storing device and a drive device. The medicine storing device includes a container and a discharge mechanism. The container stores a medicine. The discharge mechanism includes a rotary member configured to rotate at a steady speed to discharge the medicine from the container, and a first transmission mechanism including a fitting portion and operable to transmit a rotational force to the rotary member. The drive device includes a second transmission mechanism including a fitted portion, and is coupled to the first transmission mechanism via a fitting structure. The drive device is configured to provide the second transmission mechanism with the rotational force. The fitting structure is constituted from the fitting portion of the first transmission mechanism and the fitted portion of the second transmission mechanism.

In the present invention, at least one of the first transmission mechanism and the second transmission mechanism includes an energy storing member. The energy storing member is configured to allow at least one of the fitting portion and the fitted portion to be displaced to a non-fitted position and to store energy due to the displacement of the at least one of the fitting portion and the fitted portion when the fitting portion and the fitted portion are in a non-fitted state, in which the fitting portion and the fitted portion are not fitted with each other, if the medicine storing device is disposed in a predetermined cooperation enabling position with respect to the drive device. The energy storing member releases the energy to displace the at least one of the fitting portion and the fitted portion from the non-fitted position to a fitted position when the drive device provides the second transmission mechanism with the rotational force to turn the fitted portion at a predetermined speed to bring the fitting portion and the fitted portion from the non-fitted state into a fitted state, in which the fitting portion and the fitted portion are fitted with each other, in order to supply the medicine.

Since such an energy storing member is provided, at least one of the fitting portion and the fitted portion is displaced to the non-fitted position and stays at the non-fitted position in order to cause the energy storing member to store energy when the fitting portion and the fitted portion are brought into the non-fitted state in which the fitting portion and the fitted portion are not fitted with each other. When the drive device starts operation to provide the second transmission mechanism with the rotational force to turn the fitted portion at the predetermined speed in order to start supplying the medicine, the fitting portion and the fitted portion are brought into positional relationship in which the fitting portion and the fitted portion may be fitted with each other. When this state is established, the energy storing member releases the stored energy to displace the at least one of the fitting portion and the fitted portion from the non-fitted position to the fitted position. Consequently, the fitting portion and the fitted portion are kept in the non-fitted state through deformation of the energy storing member before the drive device starts operation. In the initial stage of operation of the drive device, the fitting portion and the fitted portion which have been in the non-fitted state are reliably brought into the fitted state by the energy released from the energy storing member. Thus, according to the present invention, it is possible to reliably prevent the discharge mechanism of the medicine storing device from performing unwanted discharge operation before operation of the drive device.

The present invention assumes the following cases: the fitted portion of the second transmission mechanism provided in the drive device is displaced; the fitting portion of the first transmission mechanism provided in the medicine storing device is displaced; or both the fitted portion of the second transmission mechanism provided in the drive device and the fitting portion of the first transmission mechanism provided in the medicine storing device are displaced.

The "predetermined speed" discussed earlier is preferably lower than a rotational speed of the fitted portion of the second transmission mechanism during the rotation of the rotary member at the steady speed in the medicine storing device. This allows the portion displaced by the energy released from the energy storing member to be reliably returned to its home position, thereby reliably transitioning from the non-fitted state into the fitted state.

In the case where the fitted portion of the second transmission mechanism provided to the drive device is displaced, the second transmission mechanism may include a slider and a coil spring. The slider is mounted on a drive shaft to be slidable over a predetermined movable range. The drive shaft is rotated by a rotational drive source provided in the drive device. The coil spring is disposed such that one end thereof contacts the slider and the other end thereof contacts a casing of a control section for the drive device. In this case, the coil spring serves as the energy storing member. Such a configuration simplifies the structure of the second transmission mechanism.

In a specific configuration for the case where the fitted portion of the second transmission mechanism provided to the drive device is displaced, for example, a retaining pin is provided in proximity to a distal end portion of the drive shaft to extend in a direction orthogonal to an axis of the drive shaft. A contact surface configured to contact the retaining pin is formed at an end surface of the slider opposite to the fitting portion. The slider may be provided with one ore more projecting portions located around the axis and configured to project toward the fitting portion with respect to the contact surface. The fitted portion is constituted from the distal end portion of the drive shaft, the slider, and the one or more projecting portions. In this case, the fitting portion is provided with a recessed portion to be fitted with the distal end portion of the drive shaft and the one or more projecting portions. This eliminates the need to form teeth which are difficult to form as in the related prior art.

The medicine feeder may further include attachment sensing means for sensing if the medicine storing device and the drive device are disposed in the cooperation enabling position and if the medicine storing device is brought out of the cooperation enabling position. Providing the attachment sensing means makes it possible to reliably turn the fitted portion at the predetermined speed since the medicine storing device and the drive device are disposed in the cooperation enabling position, as determined based on an output of the attachment sensing means, until it becomes certain that the fitting portion and the fitted portion establish the fitted state.

The medicine feeder may further include fitting detecting means for detecting whether or not the fitting portion and the fitted portion are fitted with each other. If the fitting detecting means is provided, the drive device rotates the discharge mechanism at the steady speed when the fitting detecting means detects the fitted state. This minimizes the period for which the fitted portion is rotated at the predetermined speed (lower speed).

BRIEF DESCRIPTION OF DRAWINGS

FIG. 1 shows the structure of a medicine feeder according to a first embodiment of the present invention, in which

FIG. 18 shows a powder medicine feeder according to the related art, in which

FIG. 19 shows a tablet feeder according to the related art, in which

FIG. 20 shows the state of fitting between a transmission mechanism provided to a storing portion and a transmission mechanism provided to a drive portion, in which

DESCRIPTION OF EMBODIMENTS

Medicine feeders according to specific embodiments of the present invention will be described below.

The embodiment shown in FIGS. 1 to 14 is an implementation of what is discussed above in SOLUTION TO PROBLEM.

A specific configuration of a medicine feeder according to an exemplary embodiment of the present invention will be described with reference to the drawings. In the accompanying drawings, for the sake of clarity etc., fasteners such as bolts, couplers such as hinges, electric circuits such as motor drivers, and electronic circuits such as controllers are not shown in detail, and components necessary for or related to description of the present invention are mainly shown.

Figure 1A:
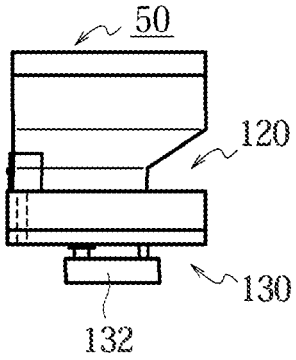
FIG. 1*a* is a left side view and FIG. 1*b* is a front view.
Figure 1B:
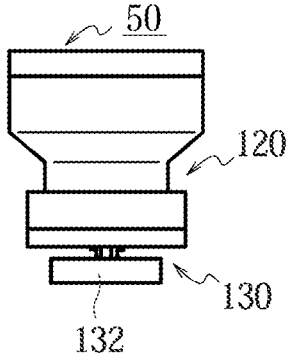
Figure 2:
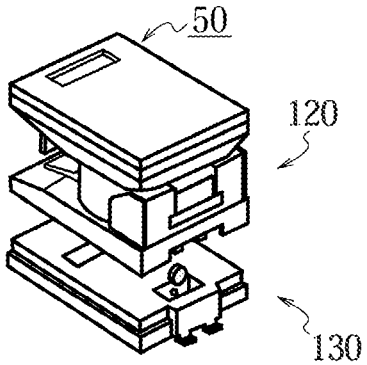
FIG. 2 is a perspective view showing the appearance of the medicine feeder as seen from the right rear.
Figure 3:
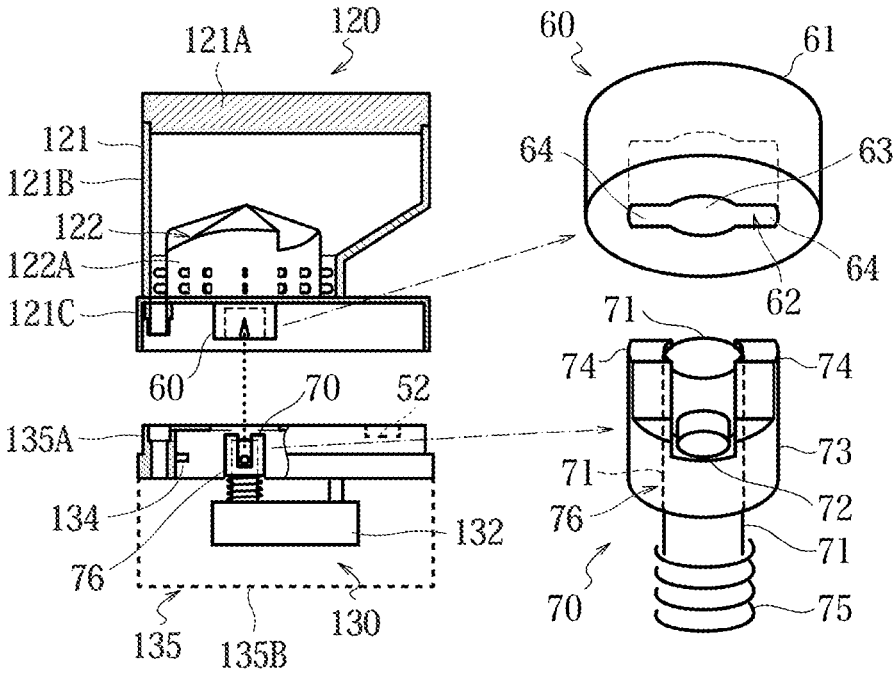
FIG. 3 includes a left side view showing a vertical section of the medicine feeder in which a medicine storing device is disengaged from a drive device to transmit no power, and a perspective view of first and second transmission mechanisms.
Figure 4:
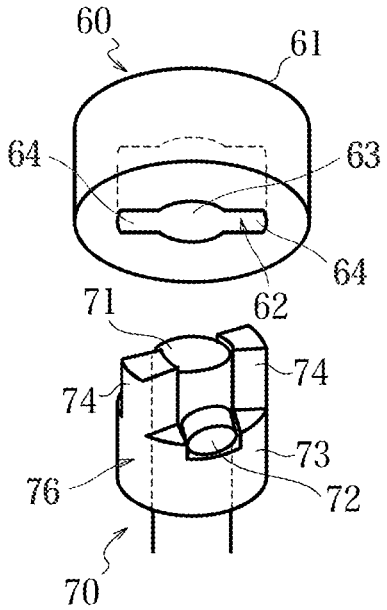
FIG. 4 is a perspective view of the first and second transmission mechanisms.
Figure 5A:
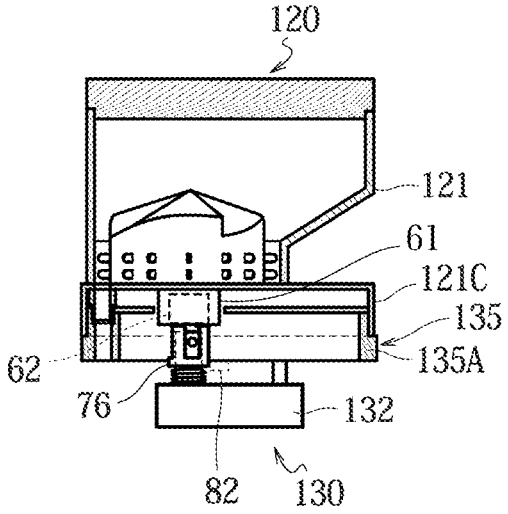
FIG. 5*a* is a left side view showing a vertical section of the medicine feeder with the transmission mechanisms in abutment with but not fitted with each other.
Figure 5B:
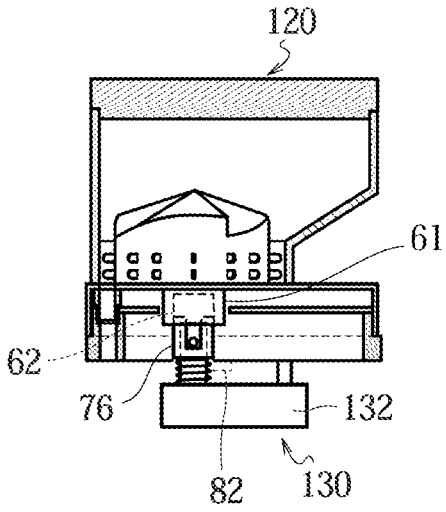
FIG. 5*b* is a left side view showing a vertical section of the medicine feeder with the transmission mechanisms fitted with each other to transmit power.
Figure 6A:
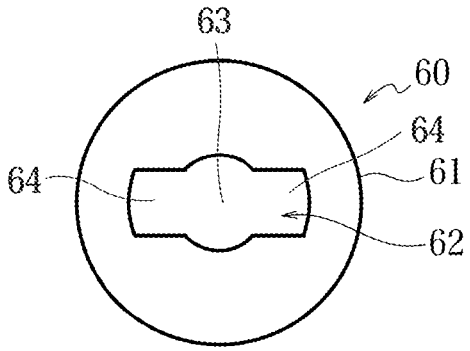
FIG. 6*a* is a plan view of the first transmission mechanism.
Figure 6B:
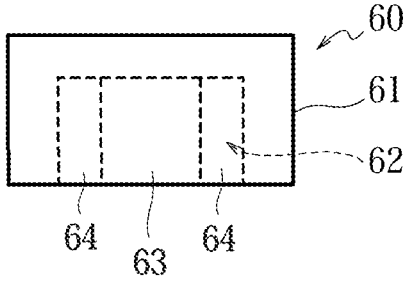
FIG. 6*b* is a side view of the first transmission mechanism.
Figure 7A:
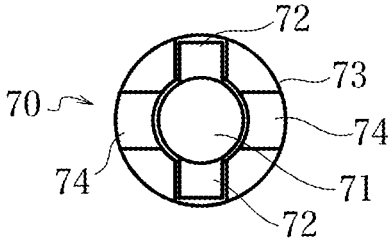
FIG. 7*a* is a plan view of the second transmission mechanism.
Figure 7B:
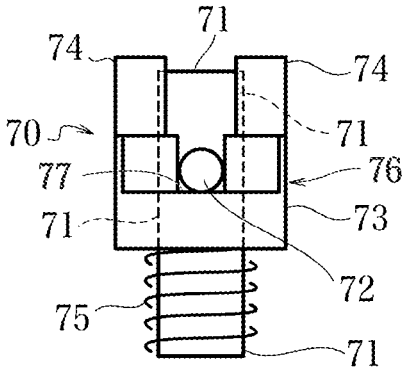
FIG. 7*b* is a side view of the second transmission mechanism.
Figure 8:
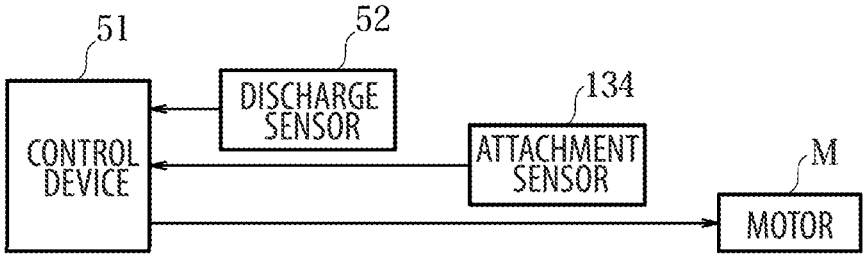
FIG. 8 is a block diagram of a control section.
Figure 9A:
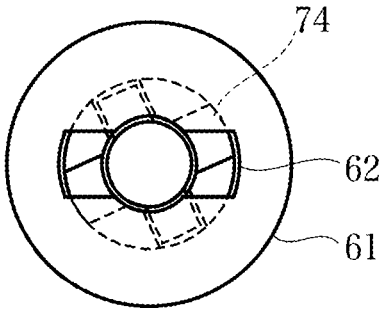
FIG. 9*a* is a plan view of the first and second transmission mechanisms.
Figure 9B:
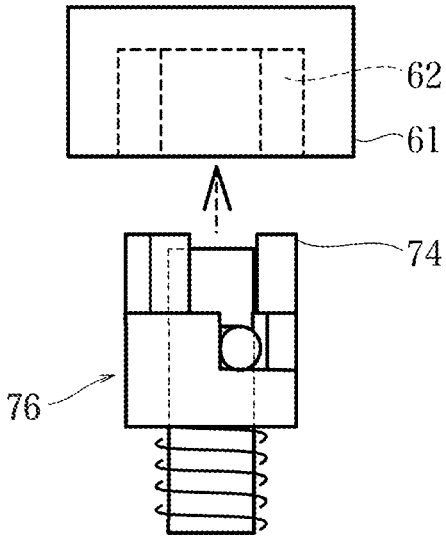
FIG. 9*b* is a side view of the first and second transmission mechanisms.
Figure 10A:
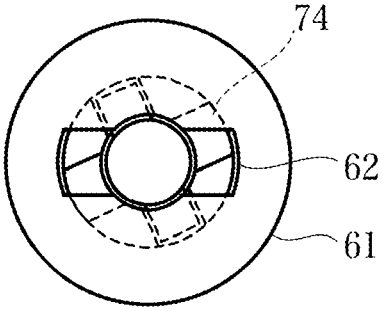
FIG. 10*a* is a plan view of the first and second transmission mechanisms.
Figure 10B:
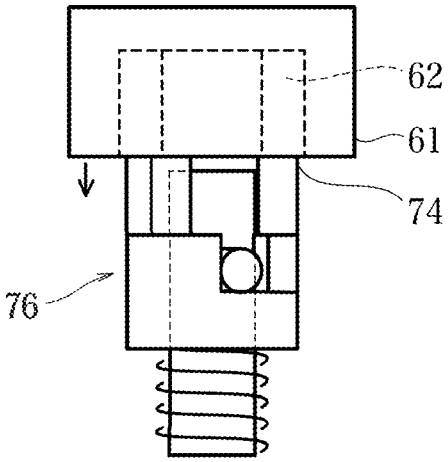
FIG. 10*b* is a side view of the first and second transmission mechanisms.
Figure 11A:
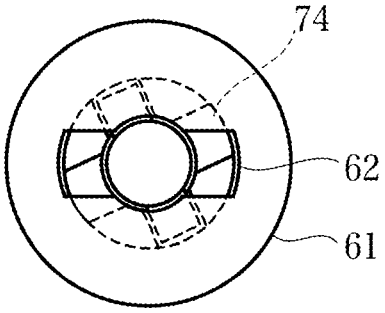
FIG. 11*a* is a plan view of the first and second transmission mechanisms.
Figure 11B:
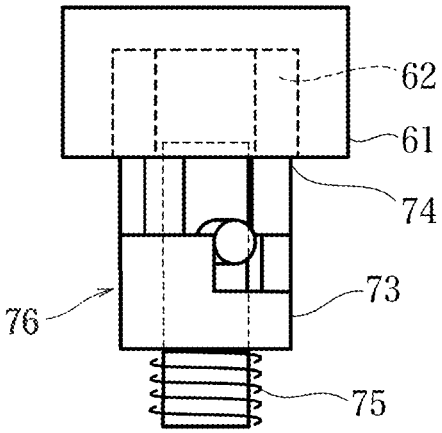
FIG. 11*b* is a side view of the first and second transmission mechanisms.
Figure 12A:
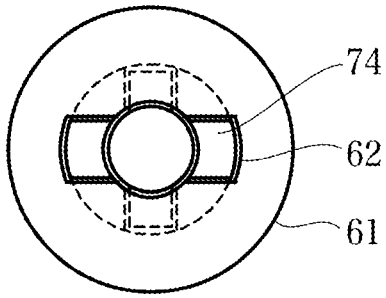
FIG. 12*a* is a plan view of the first and second transmission mechanisms.
Figure 12B:
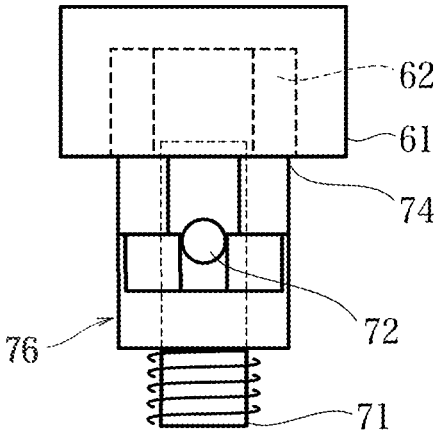
FIG. 12*b* is a side view of the first and second transmission mechanisms.
Figure 13A:
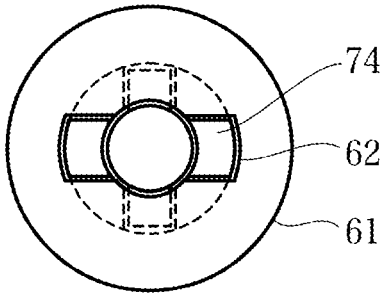
FIG. 13*a* is a plan view of the first and second transmission mechanisms.
Figure 13B:
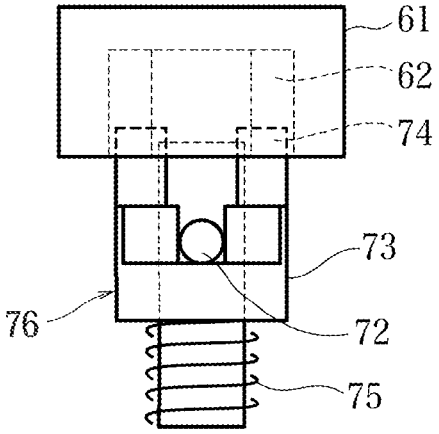
FIG. 13*b* is a side view of the first and second transmission mechanisms.
Figure 14A:
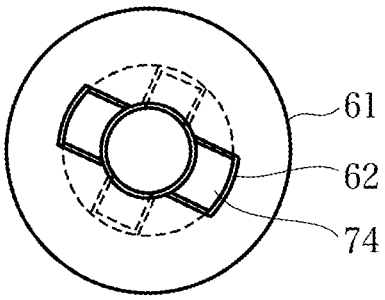
FIG. 14*a* is a plan view of the first and second transmission mechanisms.
Figure 14B:
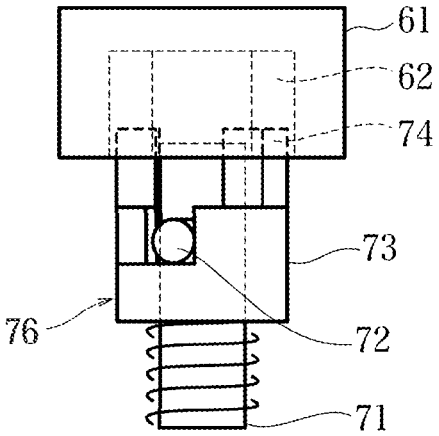
FIG. 14*b* is a side view of the first and second transmission mechanisms.

FIGS. 1*a* and 1*b* are a left side view and a front view, respectively, of a medicine feeder 50 according to the embodiment of the present invention. FIG. 2 is a perspective view showing the appearance of the medicine feeder 50 as seen from the right rear. FIG. 3 includes a left side view showing a vertical section of the medicine feeder 50 in which a medicine storing device 120 is disengaged from a drive device 130, and a perspective view of a first transmission mechanism 60 and a second transmission mechanism 70. FIG. 4 is also a perspective view of the first transmission mechanism 60 and the second transmission mechanism 70, as seen from a different angle. FIG. 5*a* is a left side view showing a vertical section of the medicine feeder 50 in which a fitting portion 61 of the first transmission mechanism 60 and a fitted portion 76 of the second transmission mechanism 70 to be discussed later are in a non-fitted state, and FIG. 5*b* is a left side view showing a vertical section of the medicine feeder 50 with the fitting portion 61 and the fitted portion 76 fitted with each other to transmit power. FIG. 6*a* is a plan view of the first transmission mechanism 60, and FIG. 6*b* is a side view of the first transmission mechanism 60. FIG. 7*a* is a plan view of the second transmission mechanism 70, and FIG. 7*b* is a side view of the second transmission mechanism 70. FIG. 8 is a block diagram of a control section. In the structure shown in FIGS. 1 to 8, constituent elements that are similar to those of the conventional medicine feeder 10 shown in FIG. 19 are denoted by reference numerals obtained by adding 100 to the reference numerals affixed to their counterparts in FIG. 19 to omit their descriptions.

The medicine storing device 120 includes a container 121 and a discharge mechanism 122. The container 121 stores therein medicines replenished when a lid 121A is opened. The discharge mechanism 122 includes a rotary member 122A configured to be rotationally driven to discharge the medicines from a through hole in the bottom portion of the container 121, and the first transmission mechanism 60 operable to transmit a rotational drive force to the rotary member 122A. The container 121 includes a container body 121B and a surrounding portion 121C. The surrounding portion 121C surrounds the first transmission mechanism 60. The first transmission mechanism 60 used in the embodiment includes the fitting portion 61 configured to form the discharge mechanism 122 together with the rotary member 122A. The fitting portion 61 functions as a shaft configured to allow the rotary member 122A to rotate with respect to the container 121. The fitting portion 61 rotates while being fitted in a circular through hole (not shown) formed in the bottom wall of the container 121. As shown in FIGS. 3, 4, and 6, the fitting portion 61 has a columnar shape. The fitting portion 61 has a fitting hole 62 formed to open in an end surface opposite to the rotary member 122A. The fitting hole 62 has a keyhole shape formed by combining a columnar hole 63 and a pair of cubic holes 64. The center of the columnar hole 63 matches the axis of the fitting portion 61. The pair of cubic holes 64 extend radially outward from the columnar hole 63. If the keyhole-shaped fitting hole 62 is considered as a gear, the fitting hole 62 corresponds to an internally toothed gear having two teeth which are arranged at a pitch angle of 180□.

As shown in FIG. 3, the drive device 130 includes a housing 135 constituted from a lid portion 135A and a housing body 135B. In FIG. 3, the housing body 135B is indicated by the dotted line. The lid portion 135A is fitted with the surrounding portion 121C of the container 121 of the medicine storing device 120. The housing 135 houses therein the second transmission mechanism 70 and a control section 132. The second transmission mechanism 70 (see FIGS. 3 to 5 and 7) includes a drive shaft 71, a retaining pin 72, a tubular slider 73, a pair of projecting portions 74, and an energy storing member 75. The drive shaft 71 is connected via a speed changing mechanism to an output shaft of a motor M serving as a rotational drive source disposed in the casing (FIG. 3) for the control section 132 of the drive device 130. The retaining pin 72 extends in a direction orthogonal to the axial direction of the drive shaft 71 from the vicinity of the distal end portion of the drive shaft 71. The slider 73 is slidably fitted on the drive shaft 71 to slide over a predetermined movable range. The pair of projecting portions 74 project in the axial direction of the shaft (fitting direction) from the distal end surface of the slider 73. The energy storing member 75 is constituted from a coil spring externally mounted on the root side or the base end side of the drive shaft 71 to urge the slider 73 toward the distal end side of the drive shaft 71 (toward the fitting direction). In the embodiment, the fitted portion 76 is constituted from the distal end portion of the drive shaft 71, the slider 73, and the pair of projecting portions 74. The distal end of the drive shaft 71 is shaped to be loosely fitted in the hole 63 located at the center portion of the fitting hole 62. The pair of projecting portions 74 are shaped to be closely fitted into the cubic holes 64 formed on both sides of the hole 63 located at the center portion of the fitting hole 62. A contact surface 77 (see FIG. 7*b*) configured to contact the retaining pin 72 is formed at the distal end surface of the slider 73 of the fitted portion 76. Thus, the fitted portion 76, which is urged by the spring, is prevented from slipping off by the retaining pin 72, and rotational motion of the drive shaft 71 is transmitted at all times to the fitted portion 76 via the retaining pin 72 even if the fitted portion 76 is moved in the axial direction of the drive shaft 71 on the drive shaft 71.

As shown in FIG. 8, a control device 51 comprising a microprocessor, for example, is provided as the control section configured to control operation of the drive device 130 (see FIG. 3). The control device 51 actuates the motor M to discharge the medicines, and stops the motor M upon detecting that the medicines are completely discharged based on the detection results of a discharge sensor 134 (FIG. 3). The drive device 130 determines whether or not the medicine storing device 120 is fitted with the drive device 130 based on an output from an attachment sensor (attachment sensing means) 52 (FIG. 3). The attachment sensor (attachment sensing means) 52 detects that the medicine storing device 120 and the drive device 130 are disposed in the cooperation enabling position and that the medicine storing device 120 is brought out of the cooperation enabling position. Providing the attachment sensor 52 makes it possible to reliably turn the fitted portion 76 at the predetermined speed since the medicine storing device 120 and the drive device 130 are disposed in the cooperation enabling position, as determined based on an output of the attachment sensor 52, until it becomes certain that the fitting portion 61 and the fitted portion 76 establish the fitted state. The medicine storing device 120 and the drive device 130 are disposed in the cooperation enabling position when the surrounding portion 121C of the container 121 of the medicine storing device 120 is completely fitted with the lid portion 135A of the housing 135 of the drive device 130 as shown in FIG. 5. The attachment sensor 52 may be a photodetector designed to output a signal while detecting light. In the embodiment, the attachment sensor 52 detects whether or not the medicine storing device 120 and the drive device 130 are disposed in the cooperation enabling position based on the presence or absence of light entering from a through hole (not shown) provided in the lid portion 135A.

The control device 51 is designed to change the rotational speed of the motor M, and hence the rotational speed of rotational member of the discharge mechanism 122, according to the detection results of the attachment sensor 52 when the motor M is actuated to discharge the medicines. Specifically, during steady operation, the drive device 130 rotates the rotational member of the discharge mechanism 122 at about 10 to 20 rpm, for example, in terms of the rotational speed of the drive shaft 71. Since the medicine storing device 120 which has been temporarily detached from the drive device 130 and brought out of the cooperation enabling position for medicine replenishment, for example, is mounted to the drive device 130 and the medicine storing device 120 and the drive device 130 are brought into the cooperation enabling position until it becomes certain that the projecting portions 74 of the fitted portion 76 and the fitting hole 62 of the fitting portion 61 establish the fitted state, in the embodiment until the drive shaft 71 is rotated by up to 180°, in contrast, the drive device 30 drives the discharge mechanism 22 at a rotational speed lower than the steady speed for the steady operation described above, for example at half the steady speed, that is, at about 5 to 10 rpm.

The usage and operation of the medicine feeder 50 according to the embodiment will be described chronologically. When using the medicine feeder 50, medicines are stored in the container 121 of the medicine storing device 120, and the medicine storing device 120 is mounted to the drive device 130. To mount the medicine storing device 120 to the drive device 130, first, the surrounding portion 121C of the container 121 of the medicine storing device 120 is aligned with the lid portion 135A of the housing 135 of the drive device 130 such that the surrounding portion 121C can be externally fitted with the lid portion 135A. Then, the medicine storing device 120 is descended. When the fitting portion 61 of the first transmission mechanism 60 is fitted with the fitted portion 76 of the second transmission mechanism 70, the drive device 130 is actuated according to control by the control device 51. The medicines are discharged from the medicine storing device 120 when the drive device 130 rotates the rotational member of the discharge mechanism 122.

Transient operation performed since the medicine storing device 120 is mounted to the drive device 130 until transition into steady operation will be mainly described below. In the medicine feeder 50, when mounting the medicine storing device 120 to the drive device 130, the fitting portion 61 of the first transmission mechanism 60 and the fitted portion 76 of the second transmission mechanism 70 are located opposite to each other with their respective axes matching each other by the alignment described earlier. Next, the medicine storing device 120 is descended to move the fitting portion 61 and the fitted portion 76 relative to each other in the rotational axis direction (the axial direction of the drive shaft 71) to reduce the relative distance until a fitted position is reached. If the projecting portions 74 and the fitting hole 62 are in a directly facing position at which the projecting portions 74 and the fitting hole 62 directly face each other (see FIG. 3) when mounting the medicine storing device 120 to the drive device 130, the fitting portion 61 and the fitted portion 76 may be fitted with each other without any axial rotation. Therefore, when the medicine storing device 120 is mounted to the drive device 130, the projecting portions 74 are fitted into the fitting hole 62 along with the descent, and thus the fitted portion 76 and the fitting portion 61 are immediately fitted with each other. In this state, the fitted portion 76 is in the fitted position.

If the projecting portions 74 and the fitting hole 62 are off the directly facing position (see FIGS. 9 and 10) when mounting the medicine storing device 120 to the drive device 130, the fitting portion 61 and the fitted portion 76 face each other but may not be fitted with each other. Therefore, the fitting portion 61 and the fitted portion 76 are not fitted with each other even when the medicine storing device 120 is completely descended to be mounted to the drive device 130. That is, when the relative distance between the first and second transmission mechanisms 60 and 70 is reduced by the descent to eliminate a gap therebetween, the fitting portion 61 and the fitted portion 76 contact and push each other (FIGS. 10 and 11), and thus the fitted portion 76 which is displaceable is moved toward the control section 132 (see FIG. 3) in the axial direction against the urging force of the energy storing member 75 just before fitting occurs. In this case, the fitting portion 61 and the fitted portion 76 are not fitted with each other, but only contact each other (see FIG. 10). In this state, the fitted portion 76 is displaced to a non-fitted position while storing energy in the energy storing member 75 (while compressing the energy storing member 75).

When the medicine storing device 120 is mounted to the drive device 130, the attachment sensor 52 detects, and thus the control device 51 recognizes, that the medicine storing device 120 and the drive device 130, which have been brought out of the cooperation enabling position, are now in the cooperation enabling position, irrespective of whether or not the first and second transmission mechanisms 60 and 70 are fitted with each other.

Then, when a command for medicine discharge is given by an upper-level controller (not shown) or a manual operation, the control device 51 actuates the motor M in response to the command. In this event, the drive device 130 rotates the rotational member of the medicine storing device 120 at the lower speed discussed above while it is possible that the fitting portion 61 and the fitted portion 76 are not fitted with each other (in the non-fitted state), that is, until the drive shaft 71 is rotated by up to about 180°.

When the second transmission mechanism 70 is rotated at the lower speed according to control by the control device 51, the projecting portions 74 and the fitting hole 62 face each other before the drive shaft 71 is rotated by up to 180°. Once the projecting portions 74 and the fitting hole 62 face each other, the fitting portion 61 and the fitted portion 76 are transitioned (from the non-fitted state) into a state in which the fitting portion 61 and the fitted portion 76 can be fitted with each other (see FIG. 12), and thus the fitted portion 76, which has been urged in the fitting direction by the energy storing member 75, is moved toward the fitting portion 61 (in the fitting direction) by the energy released from the energy storing member 75. That is, the fitted portion 76 is displaced from the non-fitted position to the fitted position. It is not before the projecting portions 74 are fitted into the fitting hole 62 that the fitting portion 61 and the fitted portion 76 are brought into the fitted state (see FIG. 13). Such fitting operation is performed while the fitted portion 76 is rotated and the fitting portion 61 is stationary. Since the rotational speed is low, the fitting operation is reliably and smoothly performed.

When the fitting portion 61 and the fitted portion 76 are thus fitted with each other, rotational motion is transmitted from the second transmission mechanism 70 to the first transmission mechanism 60 thereafter. Therefore, the first transmission mechanism 60 is also rotated together with the second transmission mechanism 70 (see FIG. 14), and thus the drive device 130 rotates the discharge mechanism 122 of the medicine storing device 120.

The drive shaft 71 is rotated by 180° before the first or second medicine discharge is completed. Thus, the control device 51 increases the rotational speed thereafter to bring the entire medicine feeder 50 into steady operation.

Figure 15:
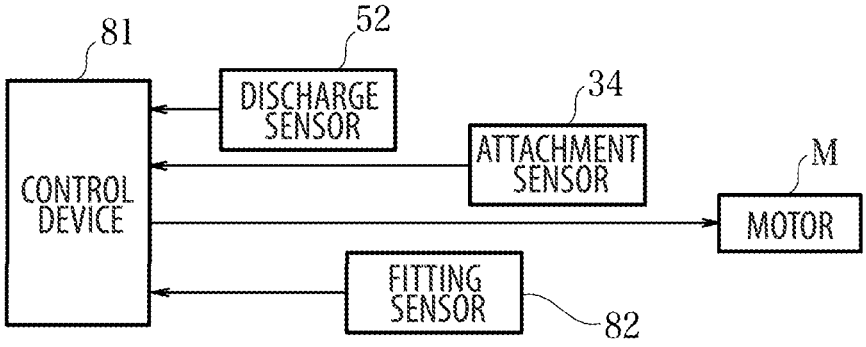
FIG. 15 is a block diagram of another control section that may be used according to the present invention.

FIG. 15 is a block diagram showing a different configuration of the control section 132. In the configuration shown in FIG. 15, a fitting sensor 82 has been added to implement fitting detecting means for detecting whether or not the fitting portion 61 and the fitted portion 76 are fitted with each other, and a control device 81 utilizes an output of the fitting sensor 82 for control. The fitting sensor 82 is of a non-contact type that uses a photodetector, for example, and is mounted to the drive device 130 to detect the presence or absence of the fitted portion 76. That is, the fitting sensor 82 is configured to detect the presence of the fitted portion 76 when the fitted portion 76 is in the state shown in FIG. 5*a*, and not to detect the presence of the fitted portion 76 when the fitted portion 76 is in the state shown in FIG. 5*b*.

When the attachment sensor 52 (see FIG. 5) detects that the medicine storing device 120 is mounted to the drive device 130, and further the fitting sensor 82 detects that the fitted portion 76 is in the fitted position close to the fitting portion 61

(when fitting is detected), the control device 81 determines that the fitting portion 61 and the fitted portion 76 are completely fitted with each other (in the fitted state). Otherwise (when fitting is not detected), the control device 81 determines that the fitting portion 61 and the fitted portion 76 are not fitted with each other (in the non-fitted state).

Further, the control device 81 changes the rotational speed of the motor M, and hence the rotational speed of rotational member of the discharge mechanism 22, between high and low levels according to the detection results of the attachment sensor 52 and the fitting sensor 82 when the motor M is actuated to discharge the medicines. Specifically, when fitting is detected, the drive device 130 rotates the discharge mechanism 122 at the steady speed discussed above. When fitting is not detected, the drive device 130 rotates the discharge mechanism 122 at the lower speed discussed above which is lower than the speed for the steady operation.

In this case, the fitting sensor 82 is provided to directly detect the fitted state between the first and second transmission mechanisms 60 and 70, and the drive device 130 rotates the discharge mechanism 122 at the lower speed before the fitting portion 61 and the fitted portion 76 are fitted with each other. After the fitting portion 61 and the fitted portion 76 are fitted with each other, the drive device 130 rotates the discharge mechanism 122 at the steady speed except for some time delay due to fitting check. Thus, use of the control device 81 minimizes the time spent on the lower-speed operation in addition to reliably and smoothly achieving fitting even during rotational operation.

Figure 16:
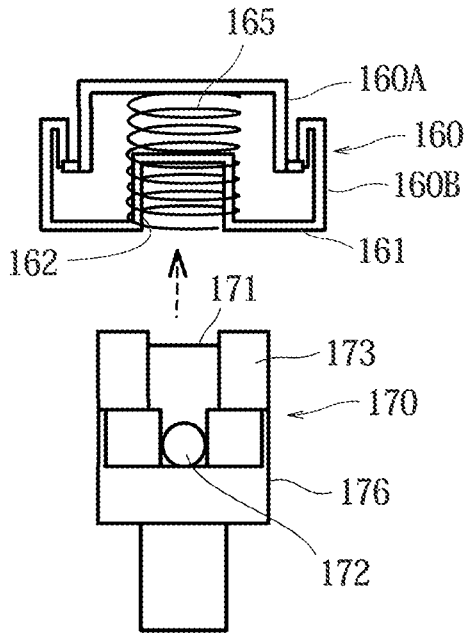
FIG. 16 is a side view of a first transmission mechanism and a second transmission mechanism that may be used in a medicine feeder according to another embodiment of the present invention.

FIG. 16 shows the configuration of a first transmission mechanism 160 and a second transmission mechanism 170 used in a medicine feeder according to an embodiment of the present invention in which a fitting portion of the first transmission mechanism provided to the medicine storing device is displaceable. The first transmission mechanism 160 includes two split half case portions 160A and 160B, and an energy storing member 165 provided therebetween. A fitted portion 176 is integrally formed in the second transmission mechanism 170. That is, the fitted portion 176 is fixed with respect to a slider 173 and a drive shaft 171. In this example, when the fitting portion 161 and the fitted portion 176 are in the non-fitted state, the half case portion 160B is displaced to store energy in the energy storing member 165. When the fitting portion 161 and the fitted portion 176 are in the fitted state, the half case portion 160B is returned to its original position by the energy released from the energy storing member 165.

Figure 17:
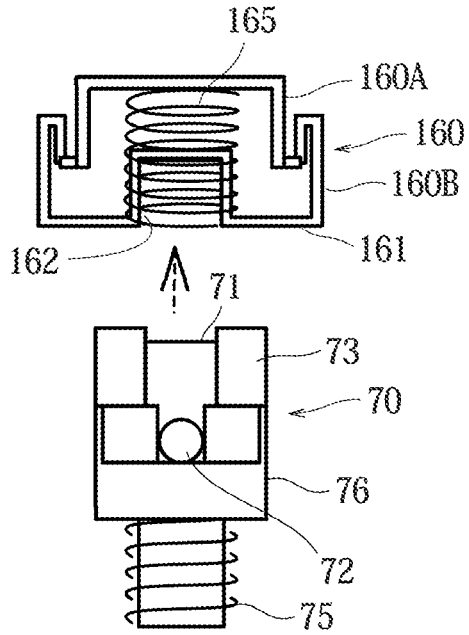
FIG. 17 is a side view of a first transmission mechanism and a second transmission mechanism that may be used in a medicine feeder according to still another embodiment of the present invention.
Figure 18A:
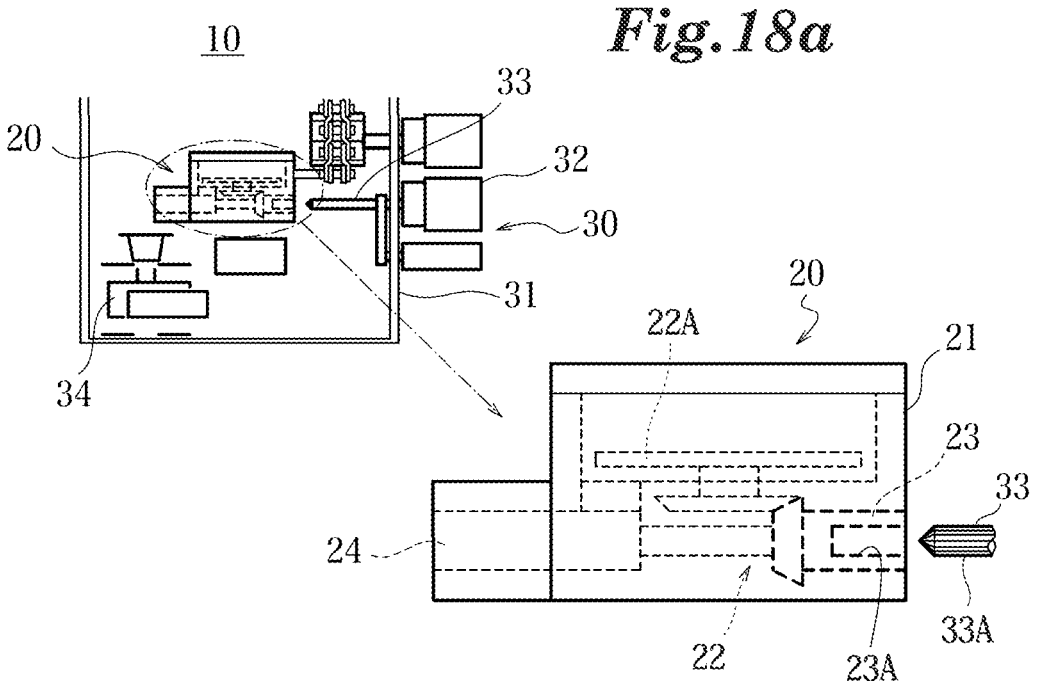
FIG. 18*a* is a side view with transmission mechanisms disengaged from each other to transmit no power and FIG. 18*b* is a side view with the transmission mechanisms fitted with each other to transmit power.
Figure 18B:
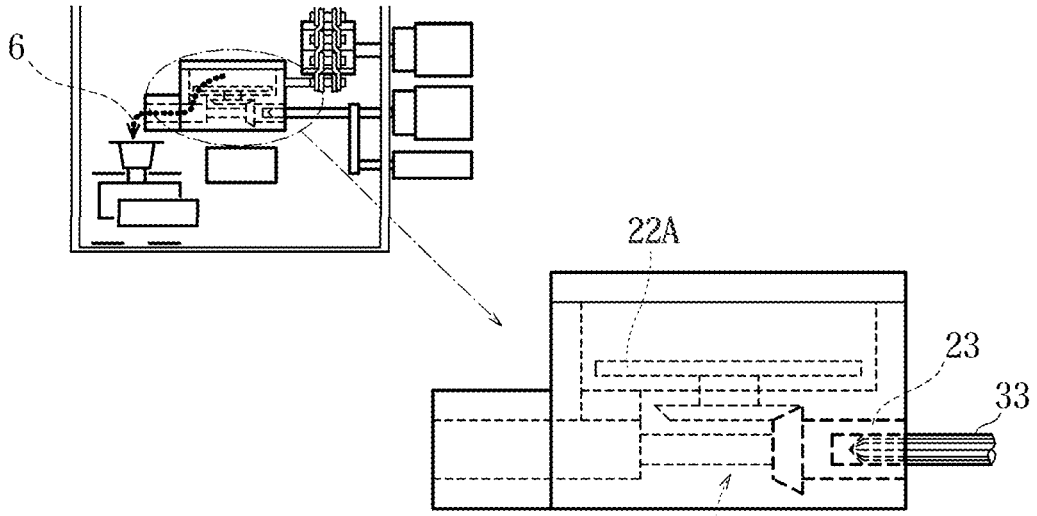
Figure 19A:
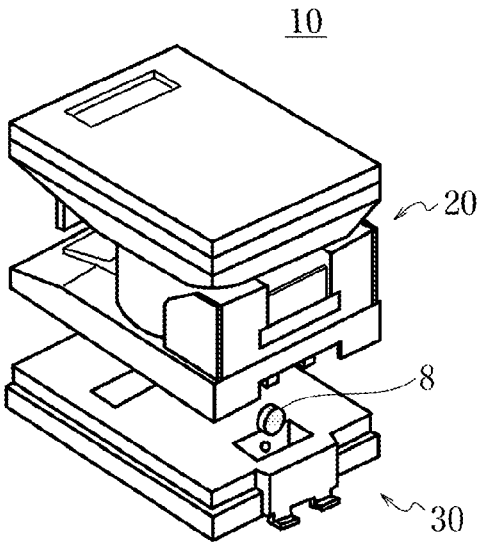
FIG. 19*a* is a perspective view showing the appearance as seen from the right rear.
Figure 19B:
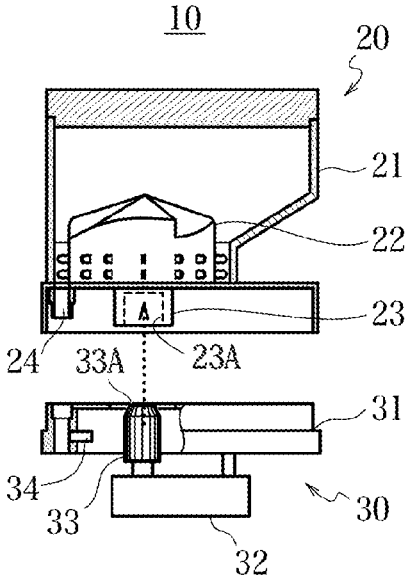
FIG. 19*b* is a left side view showing a vertical section.
Figure 19C:
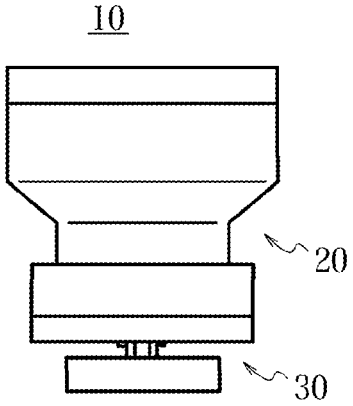
FIG. 19*c* is a front view.
Figure 19D:
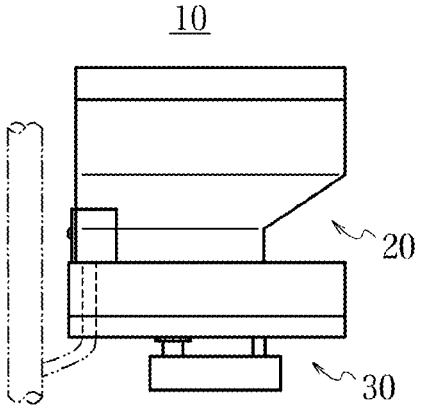
FIG. 19*d* is a left side view.
Figure 20A:
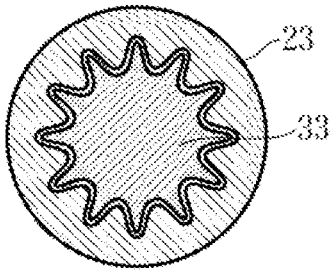
FIG. 20*a* shows a transverse cross section of the transmission mechanisms fitted with each other and FIG. 20*b* shows a transverse cross section of the transmission mechanisms disengaged from each other.
Figure 20B:
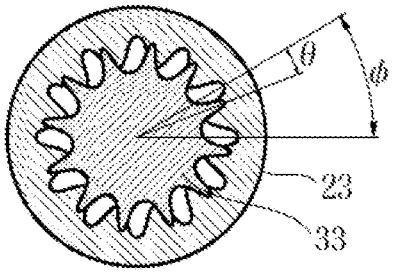

FIG. 17 shows the configuration of the first transmission mechanism 160 and the second transmission mechanism 70 used in a medicine feeder according to an embodiment of the present invention in which both a fitting portion of the first transmission mechanism provided to the medicine storing device and a fitted portion of the second transmission mechanism provided to the drive device are displaceable. The first transmission mechanism 160 is the same as that shown in FIG. 16. The second transmission mechanism 70 is the same as that shown in FIG. 3. In this example, when the fitting portion 161 and the fitted portion 76 are in the non-fitted state, the half case portion 160B is displaced to store energy in the energy storing member 165, and the slider 73 is displaced to store energy in the energy storing member 75. When the fitting portion 161 and the fitted portion 76 are in the fitted state, the half case portion 160B is returned to its original position by the energy released from the energy storing member 165, and the fitted portion is returned to its original position by the energy released from the energy storing member 75.

OTHER EMBODIMENTS

In the embodiment described above with reference to FIGS. 1 to 15, the distal end of the drive shaft 71 is fitted into the fitting hole 62. However, the drive shaft 71 is loosely fitted and does not transmit rotational motion, and thus may not reach the fitting portion 61.

In the embodiment described above with reference to FIGS. 1 to 15, the retaining pin 72 forming a transmission-engagement portion is housed in a tubular groove of the fitted portion 76 so that rotational motion is transmitted from the drive shaft 71 to the fitted portion 76. However, other modes of engagement may also be used as long as rotational motion is transmitted from the drive shaft 71 to the fitted portion 76. For example, the groove may be omitted by increasing the size of the retaining pin 72 so that the side surfaces of the projecting portions 74 and the retaining pin 72 are slidable with respect to each other in the rotational axis direction but push each other in the circumferential direction.

While a coil spring that is inexpensive and easy to use is used as the energy storing member 75 in the embodiment, other elastic members or energy storing means that utilizes a magnetic force or the like may also be used.

In the embodiment described above with reference to FIGS. 1 to 15, the fitting hole 62 is formed in the fitting portion 61 provided to the medicine storing device 120, and the fitted portion 76 provided to the drive device 130 is fitted into the fitting hole 62. However, an outer fitting member may be provided to the drive device 130, and an inner fitting member may be provided to the medicine storing device 120.

The control device 51, 81 is provided for each medicine feeder. However, the control device 51, 81 may be operable to control a plurality of medicine feeders, and may be provided at a location other than in the drive device 130.

The present invention is not limited to application to tablet feeders described in relation to the embodiment described above, and may also be applied to feeders for different types of medicines such as powder medicine feeders. The present invention is not limited to application to medicine feeders of a removable type, and may also be applied to medicine feeders of a movable-replaceable type.

A large number of medicine feeders according to the present invention may be incorporated in a storage portion such as in a medicine dispensing apparatus (see Patent Documents 1 to 4, for example). Only one medicine feeder according to the present invention may be mounted as in a tablet splitting device (see Patent Document 5, for example). A plurality of medicine feeders according to the present invention may be used in appropriate combination.

INDUSTRIAL APPLICABILITY

In the medicine feeder according to the present invention, when the first transmission mechanism and the second transmission mechanism are moved relative to each other in the axial direction with their respective axes matching each other to reduce the relative distance therebetween, the fitting portion and the fitted portion are immediately fitted with each other if the fitting portion and the fitted portion face each other in such a state that the fitting portion and the fitted portion may be fitted with each other. If the fitting portion and the fitted portion face each other in such a state that the fitting portion and the fitted portion may not be fitted with each other, the fitting portion which is displaceable is displaced while storing energy just before fitting occurs, and thus the fitting portion and the fitted portion are not fitted with each other, but only contact each other. It is not before the second transmission mechanism is rotated according to control for medicine discharge and the fitting portion and the fitted portion are transitioned into such a state that the fitting portion and the fitted portion contacting each other can be fitted with each other that the fitting portion and the fitted portion are fitted with each other. Thus, according to the present invention, it is possible to provide a medicine feeder that causes no axial rotation of the shaft beyond control during fitting.

DESCRIPTION OF REFERENCE NUMERALS

6 powder medicine (medicine)
8 tablet (medicine)
10 medicine feeder
20, 120 medicine storing device
21, 121 container
22, 122 discharge mechanism
23, 123 first transmission mechanism
24, 124 discharge passage
30, 130 drive device
31 base member
32, 132 control section
33, 133 second transmission mechanism
34, 134 discharge sensor
50 medicine feeder
51 control device
52 attachment sensor
60 first transmission mechanism
61 fitting portion
62 fitting hole
70 second transmission mechanism
71 drive shaft
72 retaining pin
73 fitted portion
74 projecting portion
75 energy storing member
81 control device
82 fitting sensor

The invention claimed is:

1. A medicine feeder comprising:

a medicine storing device including a container and a discharge mechanism, the container being configured to store a medicine, and the discharge mechanism including a rotary member configured to rotate at a steady speed to discharge the medicine from the container, and a first transmission mechanism including a fitting portion and operable to transmit a rotational force to the rotary member;

a drive device including a second transmission mechanism including a fitted portion and coupled to the first transmission mechanism via a fitting structure, and configured to provide the second transmission mechanism with the rotational force, the fitting structure being constituted from the fitting portion of the first transmission mechanism and the fitted portion of the second transmission mechanism, wherein:

at least one of the first transmission mechanism and the second transmission mechanism includes an energy storing member configured to allow at least one of the fitting portion and the fitted portion to be displaced to a non-fitted position and to store energy due to the displacement of the at least one of the fitting portion and the fitted portion when the fitting portion and the fitted portion are in a non-fitted state, in which the fitting portion and the fitted portion are not fitted with each other, if the medicine storing device is disposed in a predetermined cooperation enabling position with respect to the drive device; and the energy storing member releases the energy to displace the at least one of the fitting portion and the fitted portion from the non-fitted position to a fitted position when the drive device provides the second transmission mechanism with the rotational force to turn the fitted portion at a predetermined speed to bring the fitting portion and the fitted portion from the non-fitted state into a fitted state, in which the fitting portion and the fitted portion are fitted with each other; and fitting detecting means for detecting whether or not the fitting portion and the fitted portion are fitted with each other, wherein:

the drive device rotates the discharge mechanism at a lower speed when the fitting detecting means detects the non-fitted state than the steady speed when the fitting detecting means detects the fitted state, and the drive device rotates the discharge mechanism, changing from the lower speed to the steady speed, when the fitting detecting means detects the fitted state.

2. A medicine feeder comprising:

a medicine storing device including a container and a discharge mechanism, the container being configured to store a medicine, and the discharge mechanism being disposed in the medicine storing container and including a rotary member configured to rotate at a steady speed to discharge the medicine from the container, and a first transmission mechanism including a fitting portion and operable to transmit a rotational force to the rotary member;

a drive device including a second transmission mechanism including a fitted portion capable of displacement between a fitted position and a non-fitted position, the drive device being coupled to the first transmission mechanism via a fitting structure and configured to provide the second transmission mechanism with the rotational force, the fitting structure being constituted from the fitting portion of the first transmission mechanism and the fitted portion of the second transmission mechanism, wherein:

the second transmission mechanism includes an energy storing member configured to allow the fitted portion to be displaced to the non-fitted position and to store energy due to the displacement of the fitted portion when the fitting portion and the fitted portion are in a non-fitted state, in which the fitting portion and the fitted portion are not fitted with each other, if the medicine storing device is disposed in a predetermined cooperation enabling position with respect to the drive device; and the energy storing member releases the energy to displace the fitted portion from the non-fitted position to the fitted position when the drive device provides the second transmission mechanism with the rotational force to turn the fitted portion at a predetermined speed to bring the fitting portion and the fitted portion from the non-fitted state into a fitted state, in which the fitting portion and the fitted portion are fitted with each other; and fitting detecting means for detecting whether or not the fitting portion and the fitted portion are fitted with each other, wherein:

the drive device rotates the discharge mechanism at a lower speed when the fitting detecting means detects the non-fitted state than the steady speed when the fitting detecting means detects the fitted state, and the drive device rotates the discharge mechanism, changing from the lower speed to the steady speed, when the fitting detecting means detects the fitted state.

3. The medicine feeder according to claim 2, wherein the second transmission mechanism comprises:

a slider mounted on a drive shaft to be slidable over a predetermined movable range, the drive shaft being rotated by a rotational drive source provided in the drive device; and a coil spring disposed such that one end thereof contacts the slider and the other end thereof contacts a casing of a control section for the drive device, the coil spring being configured to serve as the energy storing member.

4. The medicine feeder according to claim 3, wherein:

a retaining pin is provided in proximity to a distal end portion of the drive shaft to extend in a direction orthogonal to an axis of the drive shaft;

a contact surface configured to contact the retaining pin is formed at an end surface of the slider opposite to the fitting portion;

the slider is provided with one ore more projecting portions located around the axis and configured to project toward the fitting portion with respect to the contact surface; and the fitting portion is provided with a recessed portion to be fitted with the distal end portion of the drive shaft and the one or more projecting portions.

* * * * *